United States Patent [19]

Vallerga

[11] Patent Number: 5,061,086

[45] **Date of Patent: * Oct. 29, 1991**

[54] SECURITY POUCH

[76] Inventor: Jose A. Vallerga, Castanon No. 1347, 1406 Buenos Aires, Argentina

[ * ] Notice: The portion of the term of this patent subsequent to Nov. 15, 2005 has been disclaimed.

[21] Appl. No.: 412,893

[22] Filed: Sep. 26, 1989

[30] Foreign Application Priority Data

Jan. 25, 1989 [AR] Argentina ..... 313068

[51] Int. Cl.[5] ..... A45C 1/00; A45C 13/10; B65D 33/06; E05B 65/52

[52] U.S. Cl. ..... 383/16; 383/33; 383/86.2; 150/102; 150/900

[58] Field of Search ..... 383/16, 33, 86, 86.1, 383/86.2, 91, 92; 70/64, 65; 190/107, 901; 150/102, 900

[56] References Cited

U.S. PATENT DOCUMENTS

| | | | |
|---|---|---|---|
| 55,416 | 6/1866 | Fye | 383/16 |
| 123,113 | 1/1872 | Lamdin | 383/16 |
| 186,827 | 1/1877 | Glover | 383/86.2 |
| 229,358 | 6/1880 | Bennett et al. | 383/86.1 X |
| 242,072 | 5/1881 | Teeters | 383/86 X |
| 259,239 | 6/1882 | Stowell | 383/86.2 |
| 375,805 | 1/1888 | Dennis, Jr. | 383/16 |
| 475,037 | 5/1892 | Cobham | 70/65 X |
| 519,598 | 5/1894 | Windsor | 70/64 |
| 598,139 | 2/1898 | Doyle | 383/86.2 X |
| 639,581 | 12/1899 | Jordan | 383/86.2 X |
| 699,431 | 5/1902 | Weller | 383/86.1 X |
| 748,209 | 12/1903 | McClay | 383/86.1 |
| 829,087 | 8/1906 | Rice | 70/65 |
| 931,853 | 8/1909 | Forehand | 190/901 X |
| 2,405,361 | 8/1946 | Langford et al. | 190/127 X |
| 2,636,531 | 4/1953 | Kelly | 383/86 X |
| 2,669,272 | 2/1954 | Permann | 383/16 X |
| 3,200,868 | 8/1965 | Strayer | 383/91 X |
| 4,175,604 | 11/1979 | Bonnier | 383/5 |
| 4,783,978 | 11/1988 | Vallerga | 383/86.2 X |
| 4,802,773 | 2/1989 | Gross | 383/16 |

FOREIGN PATENT DOCUMENTS

| | | | |
|---|---|---|---|
| 969954 | 12/1950 | France | 190/107 |

*Primary Examiner*—Sue A. Weaver
*Attorney, Agent, or Firm*—Kuhn and Muller

[57] ABSTRACT

A flexible security pouch has a wide upper mouth, a front face, a back face, a bottom and two foldable lateral faces. The pouch is provided with a foldable flap at the upper margin of the back face and a pair of straps extending laterally in opposite directions from the side margins of the back face adjacent the flap. A pair of lateral extensions are articulatedly connected to opposite ends of the flap and to adjacent straps. The straps carry labels adjacent their distal ends and are longer than half the width of the pouch.

14 Claims, 3 Drawing Sheets

SECURITY POUCH

FIELD OF THE INVENTION

The invention relates to security pouches and in particular to security pouches having a flexible sack of the type used by Financial Institutions and Banks for the safe transport of assets or various valuables by the intermediaries of persons or organizations who are responsible for making transfers.

BACKGROUND OF THE INVENTION

Pouches of the type disclosed herein are utilized in order to transport valuable material without theft or alteration of the contents of the pouches. For this purpose, these pouches use a rapid closing system complemented with a safety lock which is used to assure inviolability of the whole, since the aforementioned lock reveals any type of violation made by those who try to gain access to the content.

Such security pouches have constructive and structural characteristics which refer not only to aspects related to their load capacity, durability and ease of handling, but also to other aspects related to rapid opening, closing, loading and unloading, as well as the fact that they simplify the task of detecting violation and/or alteration of the content. Among such advantages, an outstanding one is that the mouth is reinforced with rigid, highly resistant sections, which have a structure or "core" made of steel plate, while the lateral sides, also rigid, are articulated in order to allow closing, which also helps in obtaining rapid and efficient opening and closing.

These are pouches in which, by the use of only one bolt, all their functional parts which participate in the closing are closed and superposed; therefore, the result is a flat structure coinciding with the closed mouth, which highly facilitates the checking of possible hidden cuts, during the inspection conducted prior to opening the pouch for the reception of the valuables contained. At the same time, with the advance of the bolt for closing, a backward retraction of the articulated sides is simultaneously obtained, the latter thus forming to and accommodating both folds automatically.

SUMMARY OF THE INVENTION

The pouches whose improvement is covered by this invention patent pertain to the type consisting of a special flexible sack, with a wide upper opening or mouth, and two main faces, one in front and one as a counter-face. Such pouches also have a bottom and two lateral faces which are inwardly foldable or collapsible and are of equal size. The mouth is closed by joining the front face and the counter-face, and is covered by a folding flap protruding from the counter-face and two straps which extend laterally, also from the counter-face, in such a manner as to enclose the aforementioned flap thereby producing a superposition between its extremes. This rapid closing is completed by the presence of an upper central rigid bolt, which projects from the interior surface of the counter-face and crosses, during its closing action, the front, and flap and the straps. The bolt has, in its free end, an orifice or groove for placing a lock or an inviolable safety device.

In accordance with that explained above, the loading and unloading operations are made with great ease, thus allowing considerable shortening of the time usually needed and which is generally subject to highly strict schedules. However, there are other aspects or constructive features of the invention not known heretofore which improve even more the global efficiency of the pouch.

In accordance with the present invention, wider possibilities of self-sustainment are provided particularly under circumstances in which the pouch is open in order to be loaded, for example, on premises where it hangs from a sustaining element, such as when groups of pouches are placed in orderly rows on a frame which must maintain them slanted with their mouth open at maximum. The more stable both positions are, the easier the loading task becomes for the workers. For this purpose, anchoring means comprising a pair of flexible sustainment rings are incorporated, which are placed adjacent to the lower vertex of the counter-face. The special conformation and position of the aforementioned rings avoid undesirable swing and at the same time do not interfere with, nor delay the task of hanging up and withdrawing the pouch. In addition, such rings help maintain the internal volume of the pouch in its maximum capacity for loading, whereby the suspended pouch defines a parallelpiped body with rectangular faces perpendicular among themselves. In this manner, the open pouch is more compact and completely fills up the space provided on the frame for its placement. The presence of the aforementioned eyelets prevents the back or counter-face from sliding forward and thus reducing the volume for loading.

Another advantage of the present invention is the extension from the longitudinal extremes, made in the aforementioned flap, which is projected from the counter-face as a wraparound used for the closing of the mouth. In known pouches, the aforementioned flap does not completely hide the interstices remaining in the accordion folds of the lateral faces, which it is possible to pierce with a sharp instrument such as a wire or similar object, even if all that is accomplished is damaging the content of the pouch. This disadvantage appeared in pouches which contained grains for tests and quality control by state bodies in charge of establishing the quality and consequent monetary value per unit of such grains. It was noted that, in order to devaluate such content, inferior quality grains had been subsequently introduced after the closing of the sack, thus devaluating the content and degrading same, all without leaving the possibility to check for violations or alterations in the containing sack. The present invention would not permit such alteration without there being evidence of the violation of the pouch.

Another advantage of the pouch of the present invention is the special placement of labels or signs indicating the addressee and sender. In accordance with the invention, the aforementioned labels are placed on the exterior face of the free ends of each one of the straps closing the upper opening. With the sack closed, the aforementioned ends are always superposed, so that in all cases only one label is visible from the exterior. As a consequence, these labels can be used to indicate the addressee, and then by inverting the superposition, to return the pouch to the sender, without need for incorporating any additional label. This arrangement facilitates the aforementioned needed rapidity in the use, loading and unloading of these pouches.

Finally, the present invention includes an innovative distribution of the handles of the pouch for loading, transport and unloading, which, thanks to the special conformation and, above all, placement, provide great handling ease.

In order to illustrate the advantages briefly explained above, to which users and those knowledgeable in this specialty may add many others, and in order to facilitate understanding of the constructive, structural and functional characteristics of the improvements under the invention, a preferred manufacture example is given below, schematically illustrated and without any determined scale in the attached drawings, with the express clarification that since this is an example, it must not be understood as limiting or exclusive for the scope of protection of this invention, but simply as an explanation or illustration of the basic concept on which the invention relies.

BRIEF DESCRIPTION OF THE PREFERRED EMBODIMENTS

Figures 1, 2, 3:
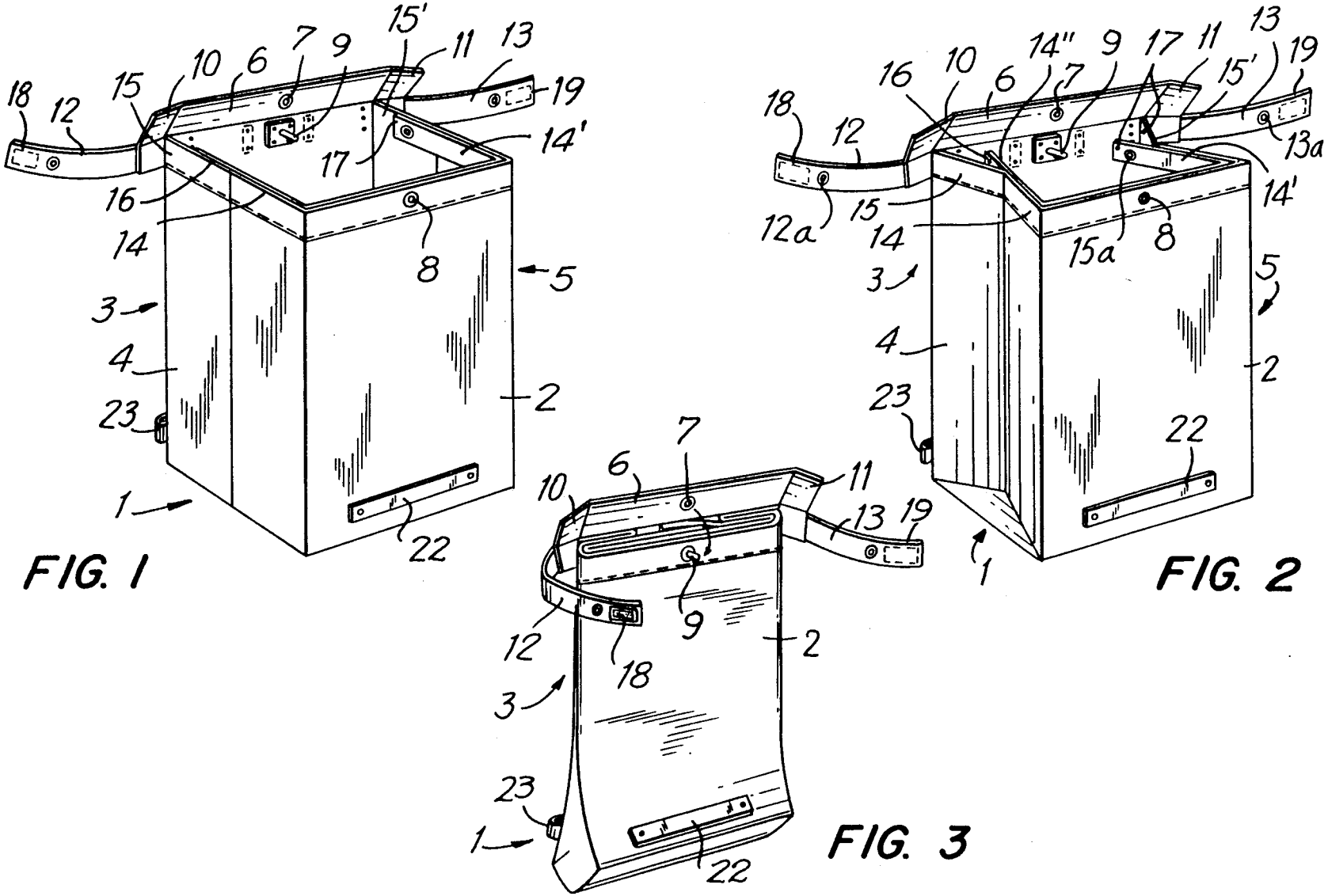
FIG. 1 is a view in perspective which shows a document pouch, in which the present invention has been incorporated, in fully open position for loading.
FIG. 2 is another view, similar to FIG. 1 showing the pouch in the first folding position for rapid closing.
FIG. 3 represents the pouch of FIG. 1 already folded, ready to be inviolably closed by its flaps and straps.

In all figures, the same reference numbers correspond to the same or equivalent parts or elements of the whole, as in the example chosen for this explanation of the invented improvements.

As seen in the aforementioned figures, the improvements covered by the present invention are applied on document pouches of the type consisting of a body 1 with a front face 2 and its counter-face 3, which faces can be superposed, due to the fact that articulated lateral faces 4 and 5 are capable of folding inwardly.

The pouch is open at the top defining a mouth. The mouth of the pouch has, on its margins, a metal frame 30 made of a stainless steel band, which gives it great rigidity for closing. The aforementioned frame is also provided in the flap 6. The flap 6 includes an eyelet 7, placed in alignment with an eyelet 8 located in the front face. When the pouch is closed, a bolt 9 protruding from the internal surface of the counter-face 3, passes through the aforementioned eyelets 7 and 8 and hides the access to the aforementioned mouth.

The aforementioned flap 6 extends laterally towards the sides having extending portions 10 and 11 articulately joined to it and which connect to the straps 12 and 13. The straps 12 and 13 also have eyelet orifices 12*a* and 13*a* which coincide or align with orifices 7 and 8 when the pouch is closed. As mentioned above, the presence of the extending portions 10 and 11 offers complete closing of the access mouth of the pouch, since there is no interstice through which access to the interior may be gained. An outstanding characteristic is that the folding and refolding movements are simultaneous with those of the flap 6 and the straps 12 and 13

It clearly results from the pouch shown in FIGS. 1, 2 and 3, that the aforementioned closing action is produced by the inwardly folding or retracting movement of the lateral sides 4 and 5, each of which is made up of two portions such as the portions 14, 15 and 14', 15' respectively depicted in FIG. 2. Both portions also include a metal reinforcement which makes them rigid. In the closed position (FIG. 3), eyelets 15*a* contained on clasp bearing arms 14' and 14'' become aligned with the aforementioned eyelet 8 and bolt 9 of the front and counter-face. The improvements under this invention include the presence of the clasps 16 and 17 such as conventional snap fasteners and the like, which are rapidly closed and opened and maintain the mouth in the position of maximum opening, which facilitates and accelerates loading. It is clear that the special location of these clasps, as well as their pressure operation, do not interfere with nor delay the tasks of the user in the handling of the pouch.

Figure 4:
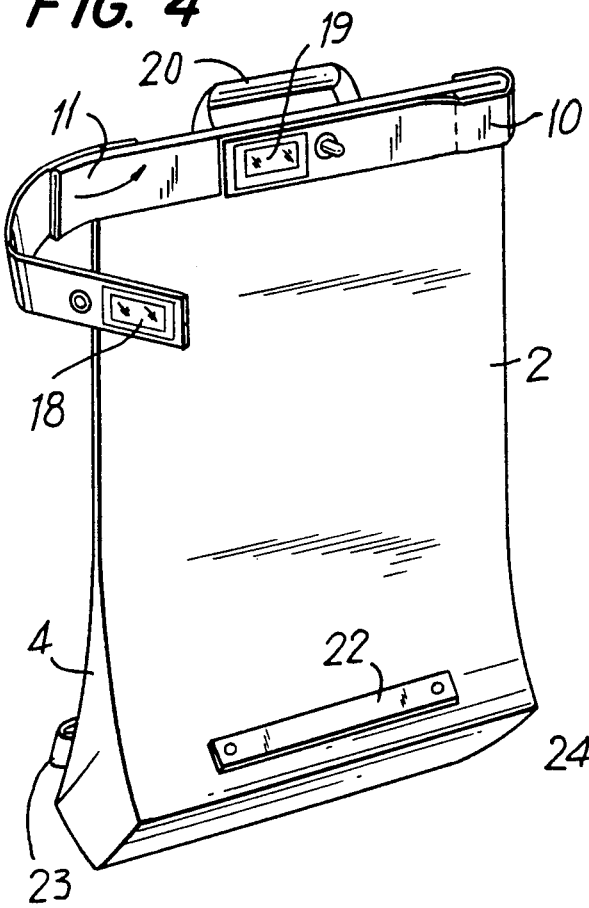
FIG. 4 shows the same pouch as the previous figures, seen from its front face.
Figure 5A:
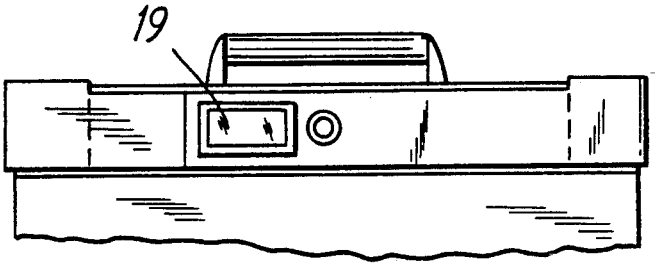
FIGS. 5A and B show two enlarged details illustrating the placement of the labels pursuant to the present invention.
Figure 5B:
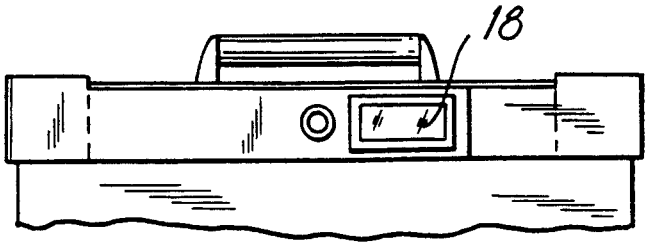

The straps 12 and 13 are longer than half the width of the pouch. Indeed, the aforementioned straps present, on the front face of their free ends, the respective labels or signs 18 and 19 (FIG. 5), so that when the pouch is closed, such as shown in FIGS. 4 and 5, the user has the option of choosing which label should be visible from the exterior. The addressee, when receiving the cargo, will only have to reverse the superposition of the aforementioned labels in order to return the pouch to the sender, perfectly closed, without need for any additional task.

Figure 6:
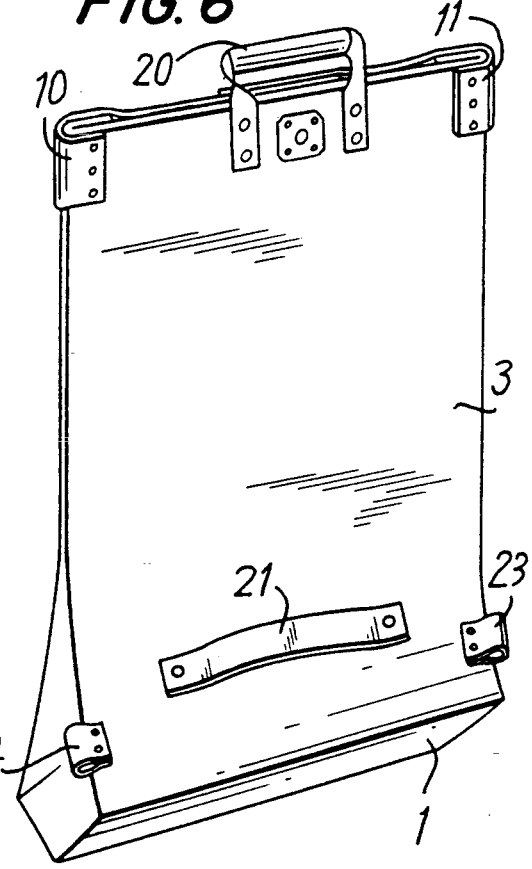
FIG. 6 shows the pouch of FIG. 4 from its back surface or counter-face.

Referring now to FIG. 6, another aspect of the invention includes the handle, indicated with reference numeral 20, which is integral with the counter-face 3 of the pouch on its exterior face. Additional handles 21 and 22 are included on the rear and front respectively, thus forming a set of three handles 20, 21 and 22, through which many alternatives are offered for the handling of the pouch. The handles may be used for manual loading, by sustaining with one hand the handle 20, since in this case the pouch must be kept open by the action of the accordion sides 4 and 5, as well as for carrying. In the event of a heavy load, the handles allow the pouch to be held by two people, one holding the pouch by handle 20 and the other by the handles 21 and 22. It is also possible, in the case of a light load, to fold the pouch and take the handles 20 and 21 with one hand at the same time, thus carrying it more comfortably. For rapid unloading, it will suffice to take the pouch by the handles 21 and 22, inverting the position of the pouch.

Figure 7:
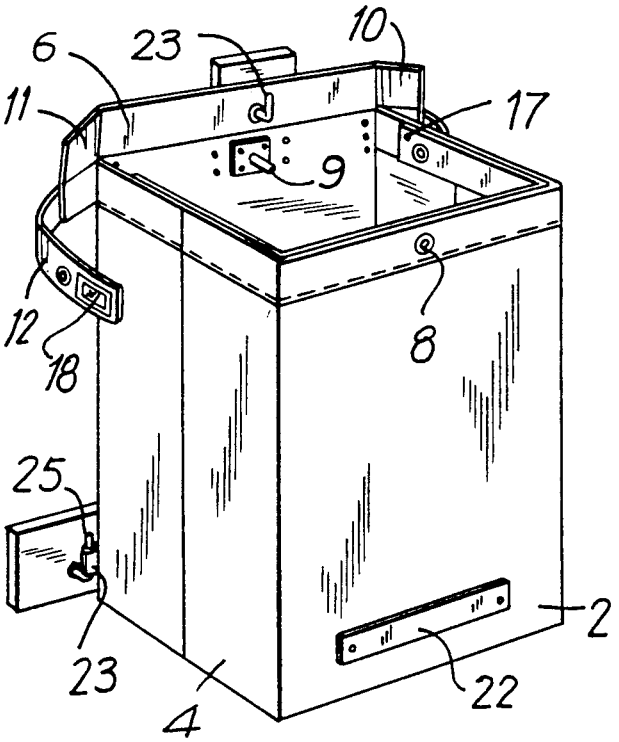
FIG. 7 shows the pouch in open position, placed on a support or sustaining element from which it can be removed.
Figure 8:
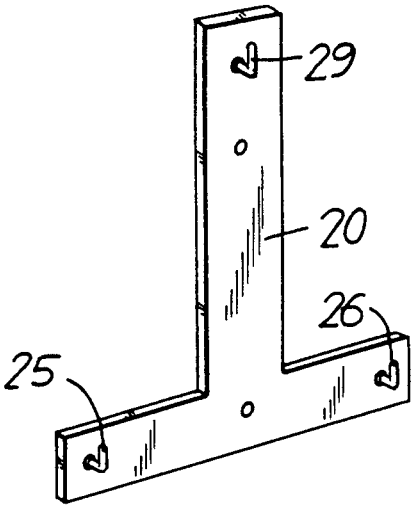
FIG. 8 shows a frame element designed for the hanging up of groups of pouches of this kind.
Figure 9:
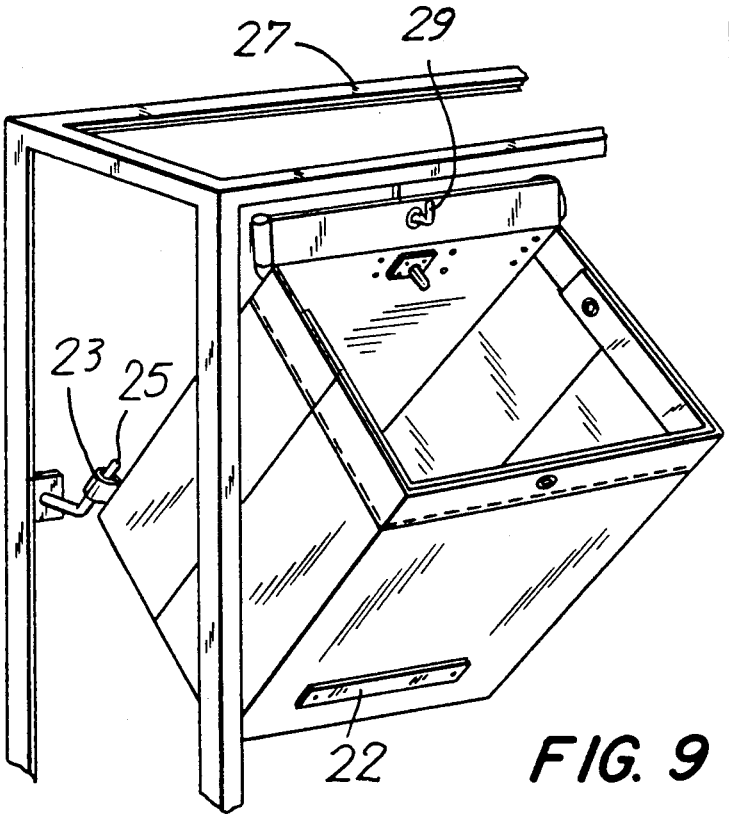
FIG. 9 is a view in perspective of the pouch of the present invention suspended in open condition from a different type of frame.

FIGS. 6, 7 and 8 show another aspect of the invented improvements, namely the presence of the lower eyelets 23 and 24, designed to be put over the hooks 25 and 26 of the frames 27 for hanging the pouches. Such frames may be used in banks for the placement of many pouches at once. Alternatively, pouch supports 28, which are merely sustaining elements, may be affixed to a wall. These hooks 25 and 26, together with the upper hook 29, allow the pouches to be maintained in a stable position during their hanging up for loading, especially helping maintain their maximum opening at the mouth and preventing any kind of undesired movement during loading, which may interfere with access to the valuables inside.

When putting into practice the improvements described and illustrated here, modifications and/or variations may be introduced, all of which must be considered as realizations covered by the scope of this invention, which scope is basically defined by the text of the claims below.

What is claimed is:

1. A flexible security pouch, having a wide upper mouth, a front face, a counter-face, a bottom and two opposite, articulated faces, comprising:

said wide upper mouth of the security pouch having rigid metal support means defining the periphery thereof;

an inwardly foldable flap at the upper margin of the counter-face having lateral extensions at the opposite ends thereof; and a pair of straps extending laterally in opposite directions from the side margins of the counter-face adjacent said flap with portions of each strap extending from the side margin of the counter-face being super-posed over portions of each of said lateral extensions of said flap, each of said straps being longer than half the width of said pouch.

2. The pouch of claim 1 in which each of said straps carries an indicia bearing surface adjacent the distal end thereof.

3. The pouch of claim 2 in which each of said indicia bearing surfaces comprises a label.

4. The pouch of claim 1 comprising rigid means for releasably securing said articulated lateral faces in an unfolded condition.

5. The pouch of claim 4 in which said rigid means comprises releasable pressure fastener means on each of said lateral faces.

6. The pouch of claim 1, wherein said flap includes rigid metal support means.

7. The pouch of claim 6 in which said metal support means comprise stainless steel.

8. The pouch of claim 1 comprising a plurality of handles on the exterior thereof.

9. The pouch of claim 8 in which one of said handles is located adjacent the top of the exterior surface of the counter-face.

10. The pouch of claim 9 in which another one of said handles is located adjacent the lower end of the counter-face.

11. The pouch of claim 10 in which yet another one of said handles is located adjacent the lower end of the front face, substantially opposite said another one of said handles.

12. The pouch of claim 1 comprising a pair of anchoring means located on the external surface of the counter-face substantially adjacent the lower vertex on each side thereof for hanging the pouch.

13. The pouch of claim 12 in which said anchoring means comprises an orifice formed as part of the pouch.

14. The pouch of claim 13 in which each of said orifices is formed from a loop adapted to receive corresponding hooks on cooperating support frames.

* * * * *